US006006495A

United States Patent [19]

Varichon et al.

[11] Patent Number: 6,006,495

[45] Date of Patent: Dec. 28, 1999

[54] AUTOMATIC BAG-DISPENSER

[76] Inventors: Denis Varichon; Frédéric Varichon, both of 35, Boulevard de l'Europe, 69110 Sainte Foy les Lyon, France

[21] Appl. No.: 09/029,675

[22] PCT Filed: Sep. 16, 1996

[86] PCT No.: PCT/FR96/01442

§ 371 Date: Mar. 3, 1998

§ 102(e) Date: Mar. 3, 1998

[87] PCT Pub. No.: WO97/09912

PCT Pub. Date: Mar. 20, 1997

[30] Foreign Application Priority Data

Sep. 14, 1995 [FR] France ..... 95 10934

[51] Int. Cl.[6] ..... B65B 43/38; B65B 67/00; B65B 43/14; B65H 3/04

[52] U.S. Cl. ..... 53/384.1; 53/390; 53/571; 271/35; 271/121; 271/118; 271/10.06

[58] Field of Search ..... 53/384.1, 390, 53/573, 571; 271/35, 121, 118, 10.06

[56] References Cited

U.S. PATENT DOCUMENTS

| | | | |
|---|---|---|---|
| 1,463,842 | 8/1923 | Ritchie et al. | 53/384.1 |
| 3,699,741 | 10/1972 | Norman | 53/571 |
| 4,231,212 | 11/1980 | Raiteri | 53/571 |
| 5,249,787 | 10/1993 | Ifkovits | 271/35 |
| 5,335,485 | 8/1994 | Cappi et al. | 53/384.1 |
| 5,833,230 | 11/1998 | Nakagawa et al. | 271/121 |

FOREIGN PATENT DOCUMENTS

| | | | |
|---|---|---|---|
| 0207838 | 1/1987 | European Pat. Off. | B65B 43/12 |
| 0429416 | 5/1991 | European Pat. Off. | B65B 43/12 |
| 0470057 | 2/1992 | European Pat. Off. | B65B 43/30 |
| 2556691 | 6/1983 | France | B65B 67/04 |

*Primary Examiner*—William E. Terrell
*Assistant Examiner*—Joe Dillon, Jr.
*Attorney, Agent, or Firm*—Harrison & Egbert

[57] ABSTRACT

An automatic bag-dispenser which includes a supply of bags (30) arranged flat in a stack (3), and two rotary devices (1, 2) which have parallel axes, are located adjacent each other and are covered with a non-slip material. The rotary devices (1, 2) rotate in counter-rotation at linear speeds which differ at their periphery. At least one of the rotary devices (1, 2) can come into contact with one of the two end bags (30) in the stack (3) in the region of the bottom (32) of the bag (30) such that it can be driven between the rotary devices (1, 2). At least one of the rotary devices (1, 2) has a central part which is not rotated and opposite which devices (4) for gripping the center part of the bag (30) are active.

7 Claims, 6 Drawing Sheets

AUTOMATIC BAG-DISPENSER

BACKGROUND OF THE INVENTION

1. Field of the Invention

This invention relates to an automatic bag-dispensing device aimed at equipping the cash desk of a store, such as a supermarket.

2. Description of the Prior Art

When passing at the cash desk, the buyer deposits his purchases onto a conveying belt, the cashier takes them one by one to enter the price of same, then deposits them onto a second conveying belt for the buyer to be able to pack them in bags.

The bags, generally made of a film of plastic material, have the drawback of being difficult to be open; it is necessary to crumple them to separate the two sides of same.

To try to cope with this drawback, devices have been proposed in which the bags are hanging in batches from hooks above a shelf and are joined to each other by an easily sectile weld seam, so that removing the outermost bag results into the opening of the next bag.

These devices have however drawbacks, e.g. it often occurs that some bags do not separate from the next ones or that they do not open.

In addition, for some of these devices, the presence of hanging hooks, which are necessarily long in order to allow the hanging of a batch of a large number of bags, is an obstacle for the filling of the bags.

SUMMARY OF THE INVENTION

This invention is aimed at overcoming these drawbacks by proposing an automatic bag-dispensing device allowing the dispensing, one by one, of open bags.

The device according to the invention includes, a recess for bags flatly arranged in a stack two rotary means with parallel spindles placed close to each other, coated with a non-slip material, rotating in opposite direction to each other at different linear speeds at the periphery, at least one of which is capable of entering into contact with one of both outermost bags of the stack, in the vicinity of the bottom of the bag, with a view to carrying same between said rotary means.

According to an additional feature of the device according to the invention, at least one of the rotary means includes a central portion not driven in rotation, in front of which acts a means for gripping the median portion of the bag.

According to another additional feature of the device according to the invention, the rotary means are placed in a casing including, in front of the contact area of the means, an opening allowing the passing through of a bag and ending in a receptacle.

In a first embodiment of the device according to the invention, the rotary means are two rollers transversely positioned, side by side, above the bags, nearly in contact with each other, rotating in opposite direction, ascending along the center, and positioned in front of the lower portion of the bags; and it includes, on the other hand, means allowing, through a vertical translation, to bring the rollers into contact with the bag located on top of the stack.

In a second embodiment of the device according to the invention, the rotary means are two belts each passing on a pair of spindles on which they move in contact with each other, the two spindles closest to the stack of bags being transversely arranged, side by side, above this latter.

In a third embodiment of the device according to the invention, the rotary means are two belts mounted on rollers, a portion of one of which being able to enter into contact with the lower bag of the stack, with a view to carrying same between the two belts.

According to the invention, the bags may be slightly longitudinally offset with respect to each other, so that all the bottoms of the bags of the stack can be seen from above, in order to avoid the welded portions from overlapping each other.

Still according to the invention, the device may include several receptacles positioned side by side, the rotary means then being mobile transversely and capable of successively moving in front of each of said receptacles to deposit a bag into same.

The advantages and the features of this invention will clearly appear from the description which follows and which makes reference to the attached drawing, which shows a non-exhaustive embodiment of same.

DESCRIPTION OF THE PREFERRED EMBODIMENTS

Figure 1:
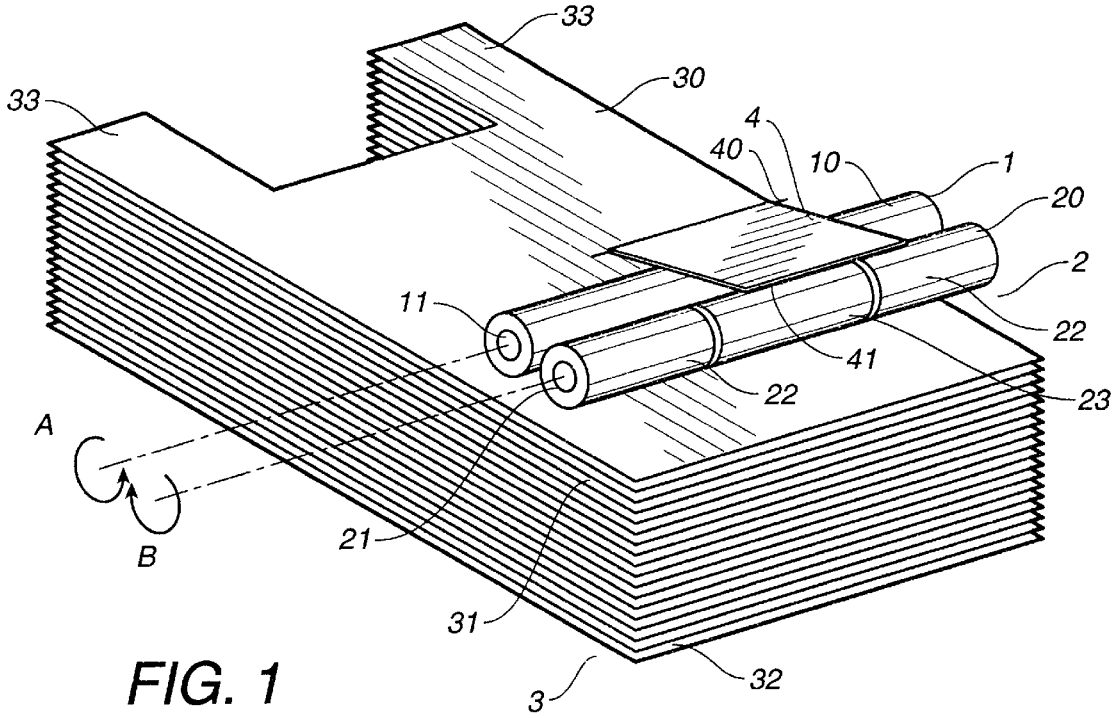
FIG. 1 shows a schematical partial perspective view of a first embodiment of the device according to the invention, FIGS. 2*a,* 2*b,* 2*c,* 2*d* and 2*e* show a schematical view of the steps of the operation of the same device.

When referring to FIG. 1, there can be seen that, in a first embodiment, the device according to the invention includes two rotary means 1 and 2, in this case parallel rollers 10 and 20 arranged side by side, nearly in contact with each other.

The rollers 10 and 20 are mounted on spindles 11 and 21, respectively, transversely above a stack 3 of bags 30, in front of the lower portions 31 of these latter, their bottoms 32 being placed on the exit side of the cash, which is not shown.

The rollers 10 and 20 are rotated in opposite direction and so that the ascending occurs along the center, according to arrows A and B, respectively.

The linear speed at the surface of roller 10, the farthest away from the bottoms 32, is slightly higher than that of roller 20, whereby this difference in speed may, with one single drive, be achieved either by using a roller 10 with a diameter larger than that of roller 20 or, when the rollers have the same diameter, through a transmission with a reducing gear.

The roller 20 is divided into three portions, two outermost rollers 22 driven in rotation and a freely rotating central roller 23 above which is arranged a plate 4 with a width substantially equal to same and mobile about a horizontal and transversal spindle 40 so that its outermost portion 41, opposite the hinged one, can enter into contact with the central roller 23.

The widths of the rollers 22 and 23 are chosen according to the distance which separates the handles 33 of the bags 30, i.e. the width of the central roller 23 should, preferably, be slightly smaller than this distance.

It should be noticed that the freely rotating central roller 23 could be replaced by a fixed portion.

When referring now to FIGS. 2, one can see the various steps of seizing and opening of a bag 30.

Figure 2A:
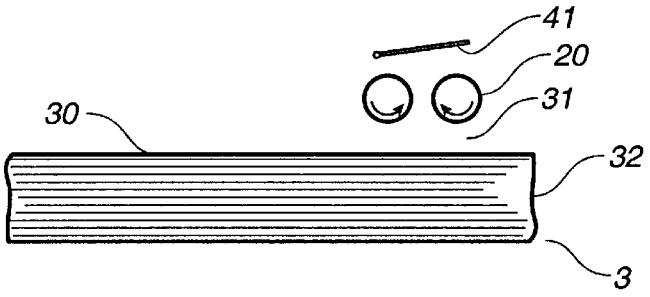
Figure 2B:
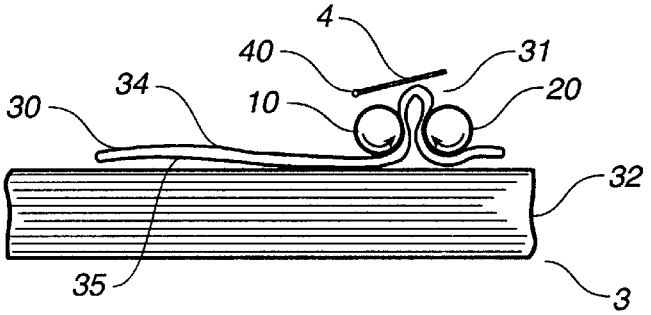

In FIG. 2*a,* the rollers 10 and 20 are at a certain distance from the lower portion 31 of the bag 30 placed on top of the stack 3.

Under the action of vertical translation means, which are not shown, the rollers 10 and 20 enter into contact with the bag 30, whereby the means may either lower the rollers 10 and 20 or cause the stack 3 to raise.

Upon the contact with the rollers 10 and 20 (FIG. 2*b*), the bag 30 is carried between the rollers 10 and 20 while being folded, whereas the vertical translation means separate the rollers 10 and 20 from the rest of the stack 3.

Figure 2C:
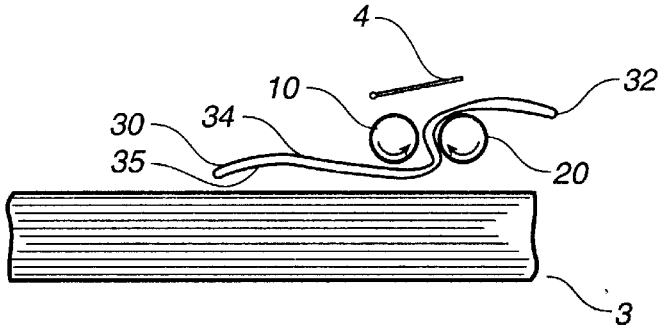
Figure 2D:
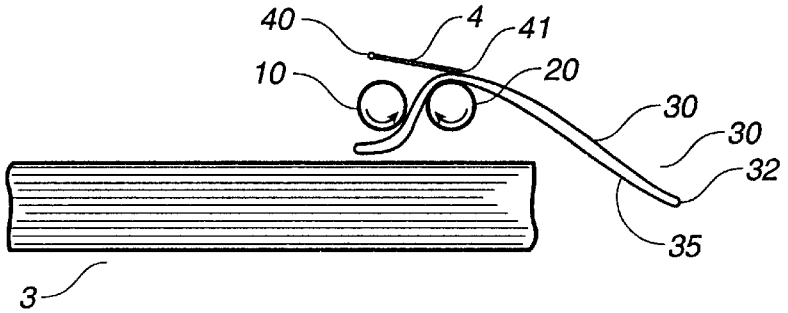
Figure 2E:
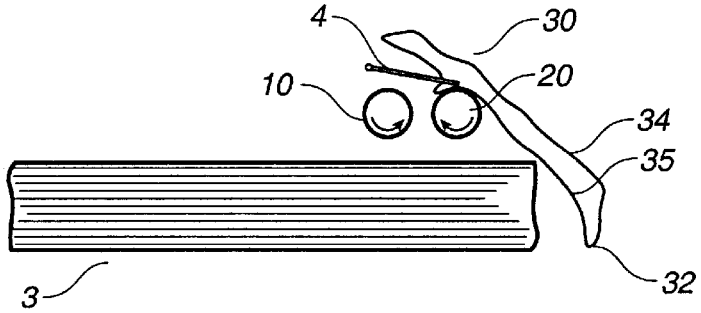

The bag 30 being seized by the rollers 10 and 20 at its lower portion 31, this latter passes between the rollers 10 and 20 before the upper portion which remains under the roller 10 (FIG. 2*c*).

Because of the difference in linear speed at the surface, the side 34 of the bag 30, in contact with the roller 10, moves quicker than the side 35 in contact with the roller 20, so that the side 34 slides above the side 35, then (FIG. 2*d*) the plate 4 pivots and its outermost portion 41 grips and holds against the central roller 23 the side 35, from the inside at the base of the handles 33 which continue to be carried by the roller 10 and the outermost rollers 22 until they are ejected (FIG. 2*e*), the side 35 still being held by the plate 4 and the roller 23.

Figure 3:
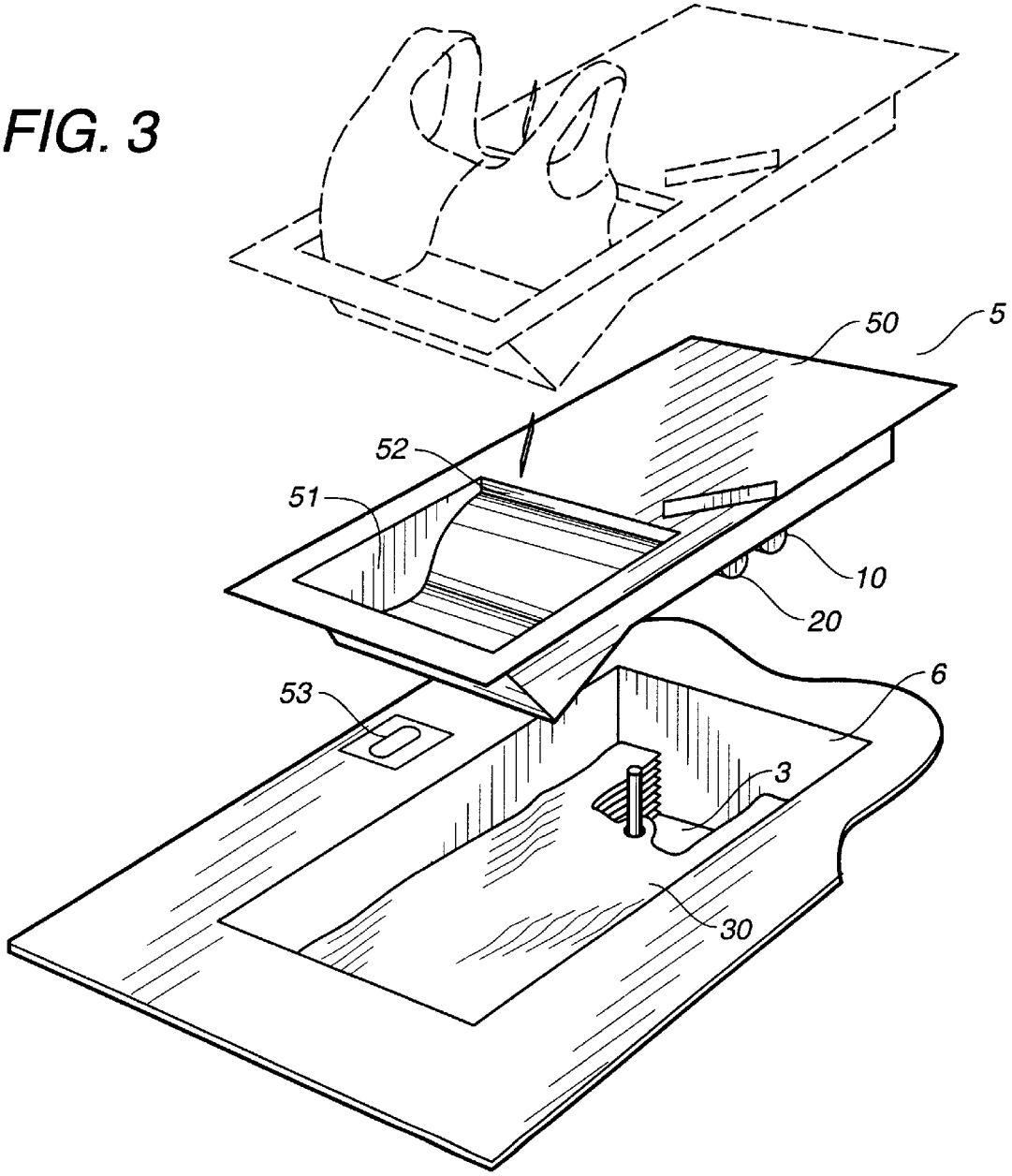
FIG. 3 shows a partial perspective and exploded view of the same device.

When referring now to FIG. 3, it can be seen that the rollers 10 and 20 are placed under a cover 5 positioned in the extension of the conveying belt of the cash desk, which is not shown, and covering a recess 6 in which is arranged the stack 3 of bags 30.

The cover 5 includes a flat area 50 ending at a container 51, a horizontal slot 52 being provided for at the end of the flat area 50 in the upper edge of the container 51, the slot 52 being in front of the roller 20.

When the bottom 32 of the bag 30 passes above the roller 20 (FIG. 2*c*), it is inserted into the slot 52, then it falls into the container 51, whilst being maintained by its side 35, as shown by interrupted lines.

Upon entering of the price of the purchased item, this latter is deposited onto the conveying belt or onto the flat area 50, the buyer pushes on a button 53 placed on the desk, which results into putting the dispensing device into operation.

A bag 30 comes out through the slot 52, the side 35 remains inserted in the slot 52, maintained between the plate 4 and the central roller 23, whereas the side 34 can easily be seized with one hand while the bag 30 is filled with the other one.

Figure 4:
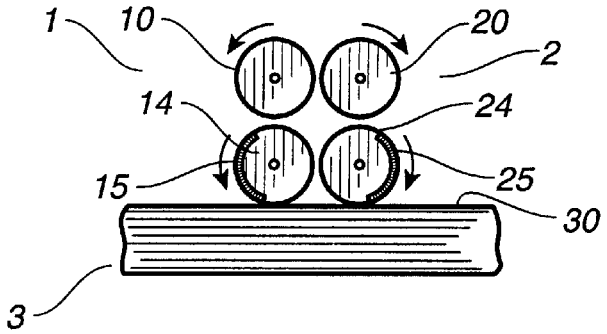
FIG. 4 shows a schematical view of a variant of the same device.

When referring now to FIG. 4, it can be seen that, in a variant, the rollers 10 and 20 are doubled at the lower side with a pair of rollers 14 and 24 positioned under the rollers 10 and 20, respectively, rotating in opposite direction, each including at the surface, on little less than half its periphery, a longitudinal non-slip area 15 and 25, the rest of the surface being smooth.

The rollers 14 and 24 are capable of vertically moving to enter into contact with the upper bag 30 of the stack 3.

The rollers 14 and 24 are programmed to perform one revolution per cycle and the smooth portions first enter into contact with the bag 30.

Under the action of the rotation of the rollers 14 and 24, the bag 30 is carried along and folded by the areas 15 and 25, then directed towards the rollers 10 and 20 to be handled there as described in FIGS. 2, the bag 30 then sliding over the smooth portions of the rollers 14 and 24 which are no longer rotated.

Figure 5:
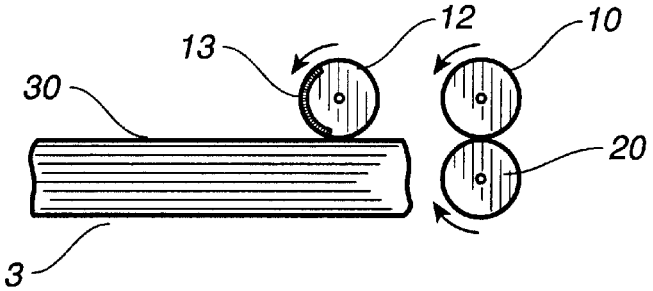
FIG. 5 shows a schematical view of another variant of the same device.

With reference to FIG. 5, the roller 10 is positioned above the roller 20 and the feeding of the bag 30 is performed by means of a roller 12 placed in front of the roller 10, transversely above the stack 3.

The roller 12 includes, on little less than half its periphery, a longitudinal non-slip area 13, its rotation, limited to one revolution per cycle, allowing to insert the upper bag 30, which it is brought into contact with, between the rollers 10 and 20.

The roller 12 and the rollers 10 and 20 are connected together and the whole is, similar to the rollers 14, 15, 10 and 20 of FIG. 4, mobile in vertical translation, thus not requiring any moving of the stack 3.

It should be noticed that, in a variant of this embodiment, the bags can be conditioned in reels which, freely rotating, can rotate under the action of a manual pulling force exerted downstream of the rollers 10 and 10 which rotate at different speeds.

Figure 6:
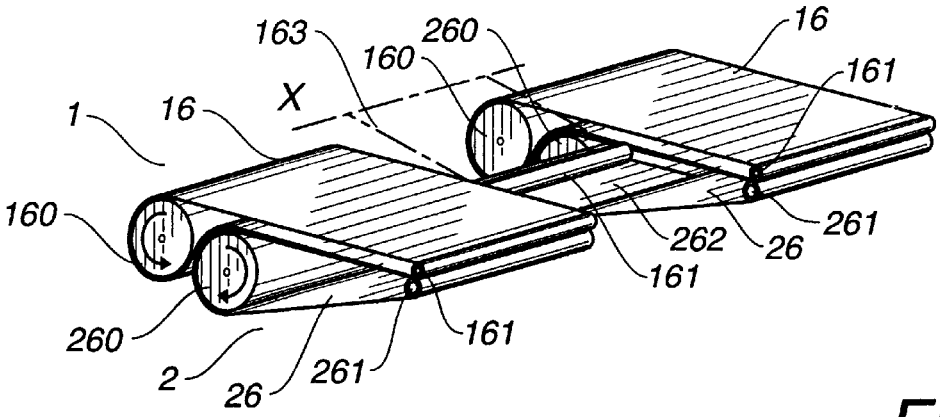
FIG. 6 shows a partial perspective of a second embodiment of the device according to the invention.

When referring now to FIG. 6, it can be seen that, in a second embodiment of the device according to the invention, the rotary means 1 and 2 are belts 16 and 26 stretched over rollers 160, 161 and 260, 261, respectively, and in contact with each other over a substantially horizontal portion.

The rollers 160 and 260, aimed at seizing the bag, which is not shown, are approximately side by side and of a large diameter, whereas the rollers 161 and 261 have a smaller diameter and are positioned above each other and in front of the slot, which is not shown, through which comes out the bag.

It should be noticed that the variants described in FIGS. 4 and 5 could be applied to this embodiment for its feeding with bags.

The belts 16 and 26 are transversely divided into two portions, in order to allow the gripping of the median portion of the bags.

This gripping is performed by means of, on the one hand, a fixed plate 262 placed substantially horizontally at the level of the area in contact with the belts 16 and 26 and the upper face of which is non-slipping and, on the other hand, a freely rotating roller 162 positioned transversely above the plate 262, at the end of an arm 163 hinged about a spindle X parallel to those of the rollers.

During the passing through of the bag between the belts 16 and 26, the roller 162 pushes same against the plate 262, whereby the lower side does no longer move, whereas the upper side continues to travel forwards.

Figure 7:
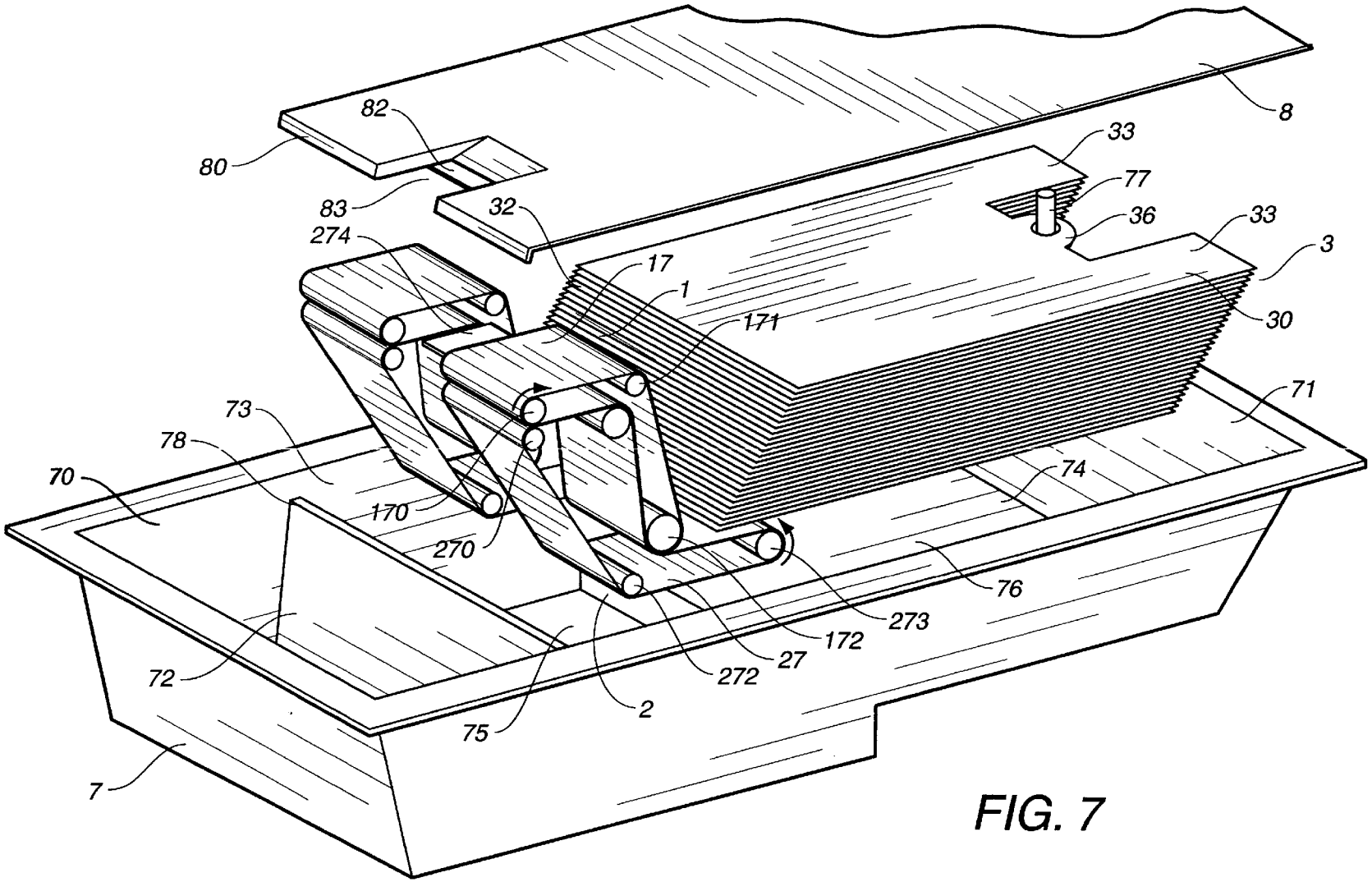
FIG. 7 shows a perspective and exploded view of a third embodiment of the device according to the invention.
Figure 8:
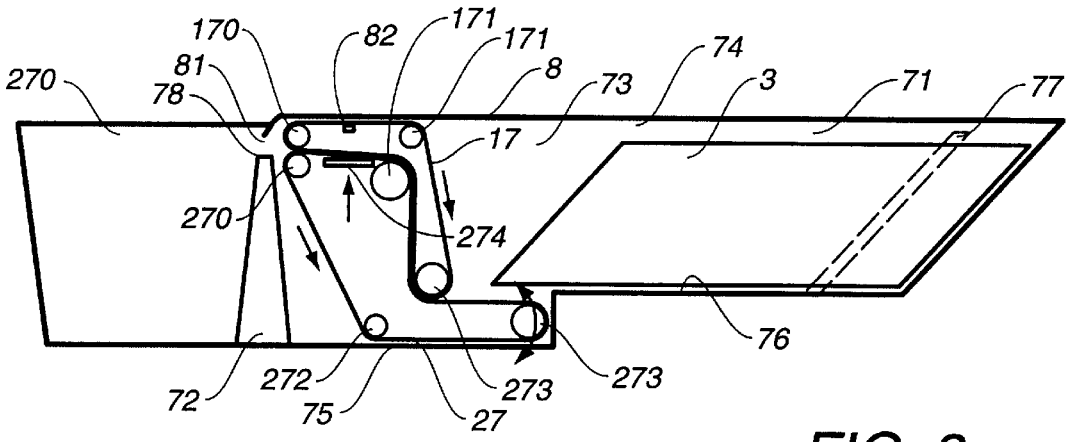
FIG. 8 shows a schematical profile view of the same device.

When referring now to FIGS. 7 and 8, it can be seen that, in a third embodiment, the rotary means 1 and 2 are belts 17 and 27 stretched over transversal rollers and in contact with each other over a substantially vertical, then horizontal portion.

The lower belt 27 is stretched over two upper rollers 270 and 271 and two lower rollers 272 and 273, the upper belt 17 being stretched over two upper rollers 170 and 171 and one lower roller 172.

The rollers 170 and 270 are positioned above each other and in the vicinity of each other, so that the belts 17 and 27 are there maintained in contact.

The rollers 170, 171 and 172 are positioned in the shape of a triangle and the rollers 270, 271, 272 and 273 are positioned in the shape of a quadrilateral, the roller 271 penetrating into said triangle, whereas the roller 172 penetrates into said quadrilateral, so that the rollers 172 and 271 simultaneously tighten the belts 17 and 27 which are thus in contact with each other between the rollers 172 and 170 and 270, passing along the roller 271.

The rotary means 1 and 2 are accommodated in a casing 7 including two compartments 70 and 71 separated by a transversal wall 72, the compartment 71 being divided into two portions 73 and 74 differing from each other by their depths, the portion 73, adjacent to the wall 72 and in which are accommodated the rotary means 1 and 2, having a bottom 75 lower than the bottom 76 of the portion 74.

The stack 3 of bags 30 rests on the bottom 76, the bottoms 32 of the bags protruding into the portion 73 above the roller 273 and the belt 27.

The bags 30 are slightly longitudinally offset with respect to each other, in order to avoid the overlapping of the welded portions, they are inserted onto an oblique bar 77 integral with the bottom 76 and passing through a removable tab 36 placed between the handles 33.

The compartment 71 is covered with a cover 8 resting on the side edges of the casing and leaving between the upper edge 78 of the wall 72 and its transversal edge 80 a space 81 in front of the rollers 170 and 270.

The belts 17 and 27 are transversely divided into two portions so as to allow the gripping of the median portion of the bags 30 through a mobile plate 274 the upper face of which is non-slipping, positioned between these two portions, at the level of the belt 27, and capable of vertically translating in order to grip the median portion of the bag against a depressed portion 82 of the cover 8 forming the bottom of a notch 83 provided for in the transversal edge 80.

The belt 27 is, at the level of the roller 273, either through vertical translation of the roller 273 or through tilting of the whole, brought into contact with the rear portion 31 of the lower bag 30 of the stack, in order to carry along same, the returning of the roller 273 into the lower position impeding the next bag 30 from being inserted.

After having been carried along by the belt 27, the bag passes between the belts 27 and 17 where it is handled in the same way as in the embodiment described above, to finally come out between the upper edge 78 of the wall 72 and the edge 80 of the cover 8 and be opened in the compartment 70.

The bags 30 descend alongside the bar 77, this movement being facilitated by the pulling force which is exerted onto the lower bag 30, since the bags are made integral with each other by a sectile weld seam.

Figure 9A:
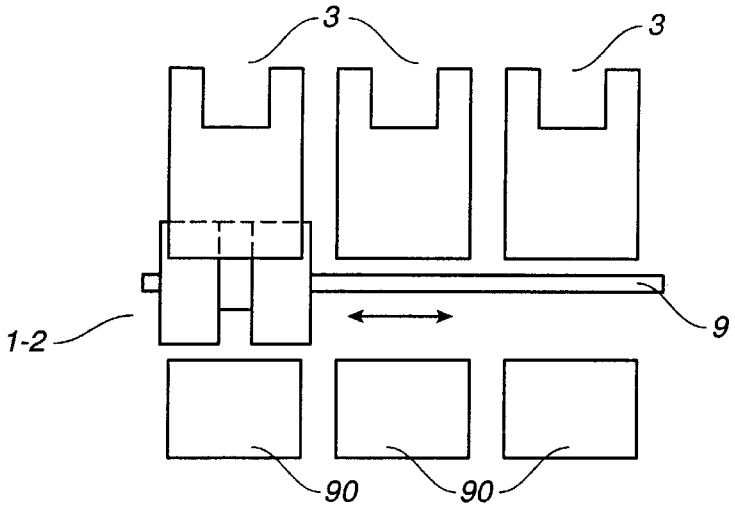
FIG. 9*a* shows a schematical view of a variant of the device according to the invention.
Figure 9B:
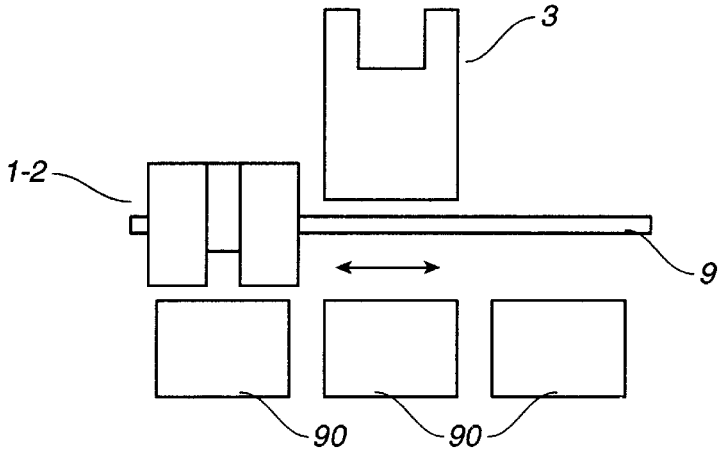
FIG. 9*b* shows a schematical view of a second variant of the same device.

When referring now to FIGS. 9*a* and 9*b*, it can be seen that the device according to the invention can, irrespective of its embodiment, be fitted in a particular configuration in which the rotary means 1 and 2 are capable of transversely moving on a rack 9, e.g. to distribute bags 30 successively in containers 90 positioned side by side, the bags 30 being taken off either several stacks 3 positioned side by side, each in front of a container 90 (FIG. 9*a*), or one single stack 3 (FIG. 9*b*).

These configurations allow the buyer to simultaneously arrange several open bags, so that he is able to arrange his purchases by sorting them if he wants to do so.

It is obvious that this invention cannot be limited to the above description of some of its embodiments likely to undergo a number of changes without therefore departing from the framework of the invention.

The above-described devices are viz. more in particular adapted for dispensing bags made of plastic material and provided with handles, but they could also be adapted for dispensing bags made of other materials and without handles.

On the other hand, the dispenser object of this invention is not aimed at being fitted only in the cash desk of a store; e.g. it can be adapted onto a packaging chain.

What is claimed:

1. An automatic bag dispenser device comprising:

a recess;

a plurality of bags flatly arranged in a stack within said recess, each said plurality of bags being a pair of sheets joined at least at a bottom edge and residing in surface-to-surface relation;

a first rotary element coated with a non-slip material; and a second rotary element coated with a non-slip material, said first rotary element being parallel and adjacent to said second rotary element, said first rotary element being driven to rotate in an opposite direction than said second rotary element, said first rotary element being driven to rotate a periphery thereof at a different linear speed than a periphery of said second rotary element, at least one of said first and second rotary elements being positioned to contact an outermost bag of said stack adjacent said bottom edge of said outermost bag, said outermost bag being carried between said first and second rotary elements such that said pair of sheets separates at least partially from said surface-to-surface relationship.

2. The device according to claim 1, said first rotary element having a central portion which is not rotatably driven, the device further comprising:

a plate positioned on a side of said first rotary element opposite said bottom edge, said plate adapted to grip a median portion of said outermost bag.

3. The device according to claim 1, further comprising:

said recess located in a casing said casing receiving said first and second rotary elements, said casing having an opening formed therein so as to allow said outermost bag to pass therethrough from said first and second rotary elements; and a receptacle positioned adjacent to said opening so as to receive said outermost bag from said opening.

4. The device according to claim 1, each of said first and second rotary element comprising a pair of belts mounted on rollers, a first belt of one of said pair of belts being mounted on three rollers arranged in a triangular shape, a second belt of said pair of belts being mounted on four rollers arranged in a quadrilateral shape, one roller of said second belt extending into said triangular shape, one roller of said first belt extending into said quadrilateral shape, said first belt contacting said second belt in an area between said one roller of said second belt and said one roller of said first belt, another roller of said second belt being positioned below said stack ahead of said bottom edge of a lowermost bag, said second belt contacting said lowermost bag and adapted to carry said lowermost bag between said first and second belts.

5. The device according to claim 4, each of said plurality of bags in said stack being offset from each other such that a bottom edge of one of said plurality of bags extends outwardly from a bottom edge of a bag positioned immediately thereabove.

6. The device according to claim 4, further comprising a casing having a first compartment and a second compartment separated by a wall, said first compartment adapted to receive the bag with separated sheets, said second compartment having a cover extending thereover, said second compartment being divided into two portions of differing depths, one of said portions being adjacent said wall and receiving said first and second rotary elements, said one of said portions having a bottom that is lower than a bottom of the other portion, said bottom of said another portion having said stack resting thereon.

7. The device according to claim 6, each of said first and second belts being separated into two portions centrally thereof, the device further comprising:

a plate having an upper face having a non-slip material thereon, said plate being positioned between said two portions and adapted to grip a median portion of said lowermost bag, said plate positioned adjacent said area in which said first belt contacts said second belt, said plate being vertically translated so as to grip said median portion against an edge of said cover above said wall.

* * * * *